US008316811B1

(12) United States Patent
Blundy et al.

(10) Patent No.: US 8,316,811 B1
(45) Date of Patent: Nov. 27, 2012

(54) METHOD AND APPARATUS FOR PRIMING VARIOUS COMPONENTS OF A DIESEL ENGINE

(75) Inventors: George R. Blundy, Walled Lake, MI (US); Ram D. Bedi, Bloomfield Township, MI (US)

(73) Assignee: K. J. Manufacturing Co., Wixom, MI (US)

( * ) Notice: Subject to any disclaimer, the term of this patent is extended or adjusted under 35 U.S.C. 154(b) by 235 days.

(21) Appl. No.: 12/703,453

(22) Filed: Feb. 10, 2010

Related U.S. Application Data

(63) Continuation-in-part of application No. 12/696,383, filed on Jan. 29, 2010.

(60) Provisional application No. 61/151,490, filed on Feb. 10, 2009.

(51) Int. Cl.
*F02M 63/02* (2006.01)

(52) U.S. Cl. ..... 123/179.9

(58) Field of Classification Search ..... 123/179.9, 123/455, 468, 469
See application file for complete search history.

(56) References Cited

U.S. PATENT DOCUMENTS

| | | | | |
|---|---|---|---|---|
| 2,945,483 | A * | 7/1960 | Howell | 123/179.8 |
| 3,750,639 | A * | 8/1973 | DiGirolamo | 123/179.13 |
| 3,929,645 | A * | 12/1975 | Bugelski et al. | 210/251 |
| 4,602,599 | A * | 7/1986 | Glagola | 123/179.9 |
| 4,747,377 | A * | 5/1988 | Schaller | 123/179.16 |
| 5,664,532 | A * | 9/1997 | August | 123/179.11 |
| 5,853,575 | A * | 12/1998 | Wydra et al. | 210/136 |
| 6,022,473 | A * | 2/2000 | Mickelson | 210/86 |
| 6,305,357 | B1 * | 10/2001 | Soukeras | 123/495 |
| 6,569,320 | B1 * | 5/2003 | Bedi et al. | 210/94 |
| 7,967,151 | B1 * | 6/2011 | Bedi et al. | 210/416.4 |
| 2002/0062822 | A1 * | 5/2002 | Watanabe et al. | 123/527 |

* cited by examiner

*Primary Examiner* — Stephen K Cronin
*Assistant Examiner* — Arnold Castro
(74) *Attorney, Agent, or Firm* — Young Basile Hanlon & MacFarlane, P.C.; Denise M. Glassmeyer

(57) ABSTRACT

A fuel priming device comprising: means for establishing releasable fluid communication with an interior volume of a fuel conveying system of an engine; a first conduit affixed to the releasable communication means for conveying diesel fuel from an engine; a pressurizable reservoir in fluid communication with the fuel conveying conduit, the device located external to the automotive vehicle associated and at least on pneumatic system controlling the removal of fuel from the diesel fuel filter.

7 Claims, 4 Drawing Sheets

METHOD AND APPARATUS FOR PRIMING VARIOUS COMPONENTS OF A DIESEL ENGINE

The present invention is directed to a method and apparatus for priming an engine fuel filter, particularly in diesel engine configurations.

Diesel engine filters must be routinely changed to insure proper function of the associated engine. These devices tend to hold significant quantities of residual fuel.

Diesel engine systems require a variety of maintenance and repair operations to ensure optimal performance. A variety of such operations necessitates action on the fuel line region and can introduce air into the fuel line. In order to maintain optimum engine function and minimize engine wear, it is desirable that the fuel circulating system of the diesel engine contain little or no trapped air. Thus it can be necessary to prime the fuel delivery system before resuming normal engine operations after various repair and/or maintenance operations.

Heretofore, engine fuel priming operations have been rather haphazard, labor intensive endeavors typically requiring introduction of diesel fuel priming material using various hand pump priming devices and the like. The fuel priming methods currently employed have other drawbacks including wide variation in priming effectiveness from operation to operation and increased opportunity for worker exposure to hazardous fuel fumes and increased risk of environmental degradation due to fuel spillage.

Thus it would be desirable to provide a fast and efficient method for priming the fuel delivery system of an associated diesel engine particularly as related to maintenance operations such as the filter element change operations as well as other procedures. It would also be desirable to provide a method and device which would facilitate the replacement of fuel in a self-contained diesel engine and efficient manner if desired or permit localized engine system repair and replacement and priming of fuel as a result of engine maintenance.

SUMMARY

A method and apparatus for priming a diesel engine and components of a diesel engine is disclosed herein. The apparatus includes a fuel reservoir; a fuel delivery conduit and a device pressurization means in pneumatic communication with a pressurization source and the fuel reservoir and at least one volumetric calibration device. It is contemplated that the device and associated method can be employed to perform various functions including, but not limited to, performing customer mandated priming operations associated with repair and preventative maintenance operations as well as priming operations associated with fuel filter unit change operations.

DESCRIPTION OF THE DRAWINGS

In order to more fully understand the present invention, the following drawing is presented in which like reference numbers are use throughout the various drawing figures and in which.

DESCRIPTION

Figure 1:
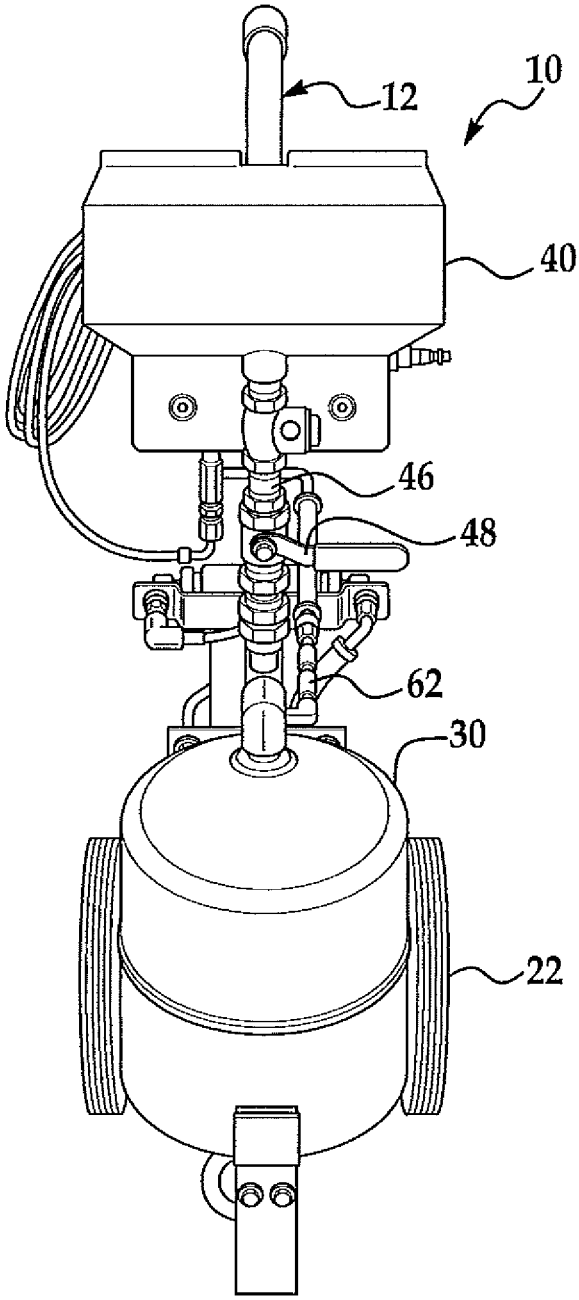
FIG. 1 is a front view of an embodiment of the fuel priming device disclosed herein.

The device and associated method disclosed herein provide a quick and effective system for priming a fuel system such as typically would be found in a diesel engine. The device and associated method disclosed herein can be employed to facilitate introduction of fuel into the fuel delivery system of an associated diesel engine. It is contemplated that the device and associated method can be utilized to prime a variety of difficult-to-prime devices located on a diesel engine including but not limited to devices such as the high pressure fuel pump and various diesel fuel filter units. The engine elements primed may be dependant, at least in part to the location of the connection point between the engine and the device disclosed herein.

In various embodiments, the device and associated method achieves introduction of diesel fuel into associated fuel conveyance line(s) conveying diesel fuel to the engine downstream and/or upstream of the target element such as the high pressure fuel pump in a manner that prevents or eliminates introduction of entrained air in the fuel conveyance system. It is also considered within the purview of this disclosure to provide a method and device that accomplishes priming of other difficult-to-prime mechanisms including, but not limited to, various fuel filters.

The device disclosed herein provides an integrated, self-contained means for efficient and effective return of diesel fuel to an engine fuel filter during various priming operations. Because the fuel priming operations are relatively easy and self-contained, it is envisioned that the device will facilitate and streamline fuel priming operations such as those associated with filter change procedures as well as other maintenance operations. This can result in cost and time savings as well as improving engine performance and/or longevity. It is also envisioned that the device and/or associated priming method can contribute to environmental quality by providing a self-contained process and device for achieving fuel priming thereby eliminating the opportunity for fuel spillage and waste. It is also believed that the device and/or associated method can also provide a device that will ensure delivery of a measured quantity of fuel into the engine during priming operations according to desired or predetermined specifications. It can be appreciated that the device and/or associated method can provide one or more of the foregoing objectives as well as other desirable advantages or attributes that have not yet been discussed or discovered.

Various systems for fuel removal and replacement have been proposed and employed. Among these is a device and method presented by the present inventors as U.S. Pat. No. 6,569,320 the content of that disclosure are incorporated by reference herein. It has been found, quite unexpectedly that the pressure/pneumatic system disclosed herein can achieve effective and efficient fuel priming operations over those disclosed in any methods and devices such as previously described and disclosed by the present inventors.

Broadly construed, the device disclosed herein includes a housing or cart configured to be positioned external to the associated automotive vehicle, a diesel fuel receptacle associated with the housing or cart, a first conduit in fluid communication with the diesel fuel collection reservoir having means for establishing releasable fluid communication with the interior volume of the fuel conveying conduit structure of the associated engine. The device also includes means for utilizing pressurized gas in at least one of the fuel priming step and/or the timing or volumetric measurement of the fuel priming step. The device may also include at least one fuel introduction element configured to facilitate introduction of quantities of fuel, particularly measured quantities of fuel, into the fuel reservoir from sources external to the associated engine. The device also may include suitable control mechanism(s) for controlling at least one of the rate of fuel delivery, volume of fuel delivery, and pressure of fuel delivery. Typically, the device includes at least one pneumatically operable control mechanism.

The device 10 as depicted in the various drawing figures can be configured as a stationary unit or a mobile unit. In the embodiment depicted in the various drawing figures, the device 10 is a mobile unit configured with a cart 12 on which the various elements can be mounted. The cart 12 may have a suitable handle 14 connected to frame 16. Frame 16 may have a suitable back 18 and a base 20. Where desired or required, the base 20 may be configured with suitable locomotion aids such as skids (not shown) or wheels 22 operationally connected to the frame in any suitable manner. In the embodiment depicted in the drawing figures, the wheels are located at the junction between the back 18 and the base 20 in order to facilitate pivotal movement of the device is about an axis associated with that junction. It is to be understood that various other configurations are considered within the purview of this disclosure.

It is contemplated that the various components of the device 10 can be affixed to the cart 12 by any suitable means. In the embodiment depicted, the various elements may be bolted welded or otherwise fastened to the cart 12. It is also contemplated that the device 10 may be configured to be stationary if desired or required. While the devise depicted is shown without an outer housing, it is contemplated that one or more of the elements of the device 10 may be located within a suitable housing as desired or required.

Broadly construed, the device 10 disclosed herein is a fuel priming unit having a means for introducing a defined amount of priming fluid (fuel) into that the fuel delivery and circulation system of an associated diesel engine under pressure conditions. Where desired or required, it is contemplated that the introduction of the priming fuel occurs at either an elevated pressure level. It is contemplated that the device will be configured with suitable means to introduce a desired volume of priming fuel over a time-calibrated interval. The pressure level during introduction can be any suitable elevated pressure that will effectively introduce the priming fuel into that associated engine.

In the embodiment as depicted in the various drawing figures, the device 10 includes at least one pressurizable fuel reservoir 30 mounted on cart 12. The pressurizable fuel reservoir 30 is releasably connectable to the associated engine (not shown) in a manner that established fluid communication between the reservoir and the fuel conveying conduit system associated with the diesel engine at a suitable location in the engine via a suitable conduit 34. The conduit 34 is configured to be detachably connectable with a suitable fitting 36 positioned in fluid communication with the fuel circulation system of the associated diesel engine (not shown). The associated fitting 36 may be positioned at any suitable location in the fuel circulation of the associated diesel engine. However in certain embodiments, the associated fitting 36 will be located at or fluidly adjacent to at least one fuel pump and/or at least one of the filter units associated with the diesel engine.

In certain engine applications where more than one engine fuel filter is employed, it is contemplated that the associated fitting will be located fluidly adjacent to the upstream fuel filter relative to delivery of fuel into the engine. In other engine applications, it is contemplated that the fitting can be located in the fuel delivery system at a location up stream of at least one of the fuel pumps located in the engine system. In this manner, the device 10 can be used to prime the desired engine element such as the associated fuel pump. In engine configurations where multiple fuel pumps are utilized, it is contemplated that the coupling member 36 will be located upstream of suitable high pressure fuel pumps in order to deliver a suitable volume of diesel fuel as priming fluid to the high pressure fuel pump and surrounding conduits.

It is contemplated that fitting 36 may be a suitable quick connect fitting capable of facilitating delivery of fluid into the associated engine in an efficient and effective manner. Where desired or required, the fitting 36 can be configured to permit delivery of fuel at elevated pressure. Where desired or required, the fitting 36 can be configured to accommodate two-way fluid flow; i.e., introduction of diesel priming fuel and periodic removal of diesel fuel at appropriate intervals.

The fitting 36 can be one that is manufactured into the associated engine or can be added by suitable retrofit. In certain embodiments, it is contemplated that the fitting can be configured as a suitable "posilock" valve that can be used to assess various engine diagnostics in addition to facilitating fuel delivery and/or removal. These devices are sometimes referred to a compucheck valve and are configured to permit or facilitate communication with a variety of monitoring and sensing devices associated with the engine.

The conduit 34 may be constructed from any suitable material or materials. In various embodiments, the conduit 34 of the device 10 is composed of a flexible fuel resistant material of a suitable length to extend from the device 10 to the associated vehicle to be serviced. In order to facilitate fluid communication between the device 10 and the associated vehicle, it is contemplated that the conduit 34 can be configured with a suitable mating fitting 38 to establish releasable fluid connection between device 10 and the associated engine (not shown) as at fitting 36. In various embodiments, it is contemplated that the conduit fitting 38 may be a suitable locking coupling member such as a POSILOCK diagnostic connection. Where desired or required the device 10 may be configured to assess various diagnostic data derived from the coupling. However, it is also within the purview of the present disclosure to employ a suitable filtering and device without such capabilities.

The end of the conduit 34 distal to the conduit fitting 38 is connected in fluid communication with the pressurizable fuel reservoir 30 by a suitable fitting mounting or the like. The conduit 34 may be connected to the reservoir 30 at any suitable location to facilitate pressure assisted evacuation of at least a portion of fuel continued in the reservoir 30 from the reservoir through the conduit and into the fuel conveying lines of the associated diesel engine.

In the embodiment depicted in the drawing figures, the junction between reservoir 30 and conduit 34 is positioned at a lower portion of the reservoir 30 when the device is positioned in the operational orientation as illustrated in the drawings The pressurizable fuel reservoir 30 will have any suitable internal volume sufficient to deliver at least one priming charge to an associated engine. In various embodiments, it is contemplated that the internal volume of the device will be configured to limit delivery to one measured charge at a time. However, it is considered within the purview of this disclosure to provide measured volume priming delivery through measurement tools other than that or the internal reservoir volume if desired or required.

The device 10 will also include suitable means to introduce fuel into the fuel reservoir 30. It is contemplated that fuel will be introduced or charged into the reservoir 30 prior to the engine priming operations. The introduced fuel can be obtained from at least two different sources: external fuel receptacles or the associated engine itself. It is contemplated that fresh fuel can be added to the reservoir from any suitable receptacle such as gas can, fuel pump or the like. Given the mobile nature of the device 10, fresh diesel fuel can be introduced from any suitable external fuel source and device 10 containing the introduced fuel can be transported to the location of the diesel engine regardless of proximity to the source of the fresh fuel.

Where introduction of fuel into the pressurizable fuel reservoir 30 from an external fuel source is desired, the device 10 can be configured with suitable means to accommodate such introduction. The external fuel introduction means can be configured in various suitable manners.

In the embodiment depicted in the drawing figures, device 10 includes an upper reservoir 40 that is positioned above the pressurizable fuel reservoir 30 when the device is in the upright operational position. Upper reservoir 40 can have any suitable configuration and volume sufficient to hold a measured volume of diesel fuel to be used as priming material. In the embodiment depicted in various drawing figures, the upper reservoir 40 is a covered chamber 42 with a pivotal or removable lid 44. A volume of fluid can be introduced into the upper reservoir 40 and conveyed into pressurizable fuel reservoir 30 by suitable conduits. In the embodiment depicted, conveyance is by gravity. Other methods of conveyance such as pumping and the like can be employed instead of, or in addition to, gravity conveyance. The chamber configuration as depicted is one that may be suitable for the introduction of spent fuel filters therein. It is contemplated that, where desired or required, the various spent diesel fuel filters can be placed in the upper reservoir in a manner that permit any contained diesel fuel to drain out into the upper chamber to be conveyed into the pressurizable reservoir 30 for eventual reuse. Where such option is not required, it is contemplated that the upper chamber can be of any configuration suitable for collecting and delivering fuel into the reservoir 30.

In the embodiment depicted, the upper reservoir 40 will be configured to have an inner volume capacity compatible to that of the pressurizable reservoir 30. Upper reservoir 40 is in fluid communication with the pressurizable fuel reservoir 30 via a suitable conduit or conveyance path. As depicted in the drawing figures, the conduit is depicted at reference numeral 46. In the embodiment as depicted the conduit 46 may be configured with a suitable closure valve 48 which can be moved from an opened position during operations filling the pressurizable reservoir 30 and a closed position to be utilized at other times. For example, in various embodiments, the closure valve 48 will be in the closed position during transit of the device 10 from location to location as well as during priming operations. In the embodiment depicted in the drawing figures, the closure valve 48 is a hand-operable valve located in the conduit approximately midway between the upper reservoir 40 and the pressurizable fuel reservoir 30. The closure valve 48 can be configured to provide pressure tight closure between the conduit upper reservoir 40 and the fuel reservoir 30.

It is also contemplated that the conduit 46 can be configured with one or more suitable check valves such as ball valves, and the like to prevent the return of fuel into the upper reservoir once fuel is introduced into the pressurizable fuel reservoir 30.

The pressurizable fuel reservoir 30 can be configured with a suitable drain opening or spigot 50 configured to provide fluid access in the interior of the chamber as needed. It is contemplated that the drain valve or spigot 50 will be positioned in the lower portion of the reservoir 30 to permit drainage of any residual fuel, sediment, water or other material that may accumulate in the reservoir 30 over time.

The fuel delivery conduit 34 can be connected to the pressurizable reservoir 30 at any suitable location and can be connected by suitably fluid tight connection means. In various embodiments, it is contemplated that the fuel delivery conduit 34 will be located at a position above the fluid level of spigot 50 but in the lower region of the reservoir 30 when the device 10 is positioned in the use position as depicted. In many instances, it is contemplated that the conduit 34 will be located in the lower third portion of the reservoir 30 when the reservoir in the in upwardly oriented or use position.

The device 10 also may include at least one suitable onboard fuel filtration unit 52. The onboard fuel filtration unit 52 may be positioned in the fluid conduit 34 in the device 10 so as to permit and facilitate introduction of freshly filtered fuel into the associated engine during priming operations. The embodiment in FIGS. 1, 3, and 4 contemplates positioning of the filtration unit in fluid communication with conduit 34 at a location downstream of the reservoir 30.

Where desired or required, the fuel filtration unit 52 or components thereof can be removable or replaceable. It is also contemplated that the fuel filtration unit can be equipped with suitable means (not shown) for indicating filter replacement is required. Such indicator means can include, but need not be limited to, visual, electronic or non-electronic signals triggered by events such as a change in condition of the filtration media or the volume of contaminant accumulated in the filtration unit 52. It is also contemplated that the filtration unit 52 can also be equipped with suitable self-regeneration devices as desired or required.

In various embodiments, it is contemplated that the filtration unit 52 can contain suitable filtration media capable of removing contaminants from hydrocarbon materials such as diesel fuel. Such filtration media may comprise one or several different materials as required to accomplish suitable fuel filtration. It is anticipated that such filtration media will be capable of removing contaminants such as by-products of incomplete combustion of the diesel fuel as well as contaminants derived from the engine itself. Such contaminants include, but are not limited to, metallic or metal-base materials which result from the engine operation and parts contained therein. Other contaminants may include components derived from engine lubricants, seals and gaskets, and the like. Additionally, the filtration media contained in the fuel filtration unit 52 can be material that is capable of removing or sequestering various contaminants derived from the external environment such as road dirt particles and the like.

The filtration media employed in associated filtration unit 52 may be of a type which is removable from the associated filter housing 54 on a periodic basis when the media becomes saturated or unable to provide suitable filtration function. Alternately, it is considered within the purview of this disclosure that the entire filter unit with filtration media contained therein will be removable from device 10 to permit replacement with a fresh filtration unit 52.

Figure 3:
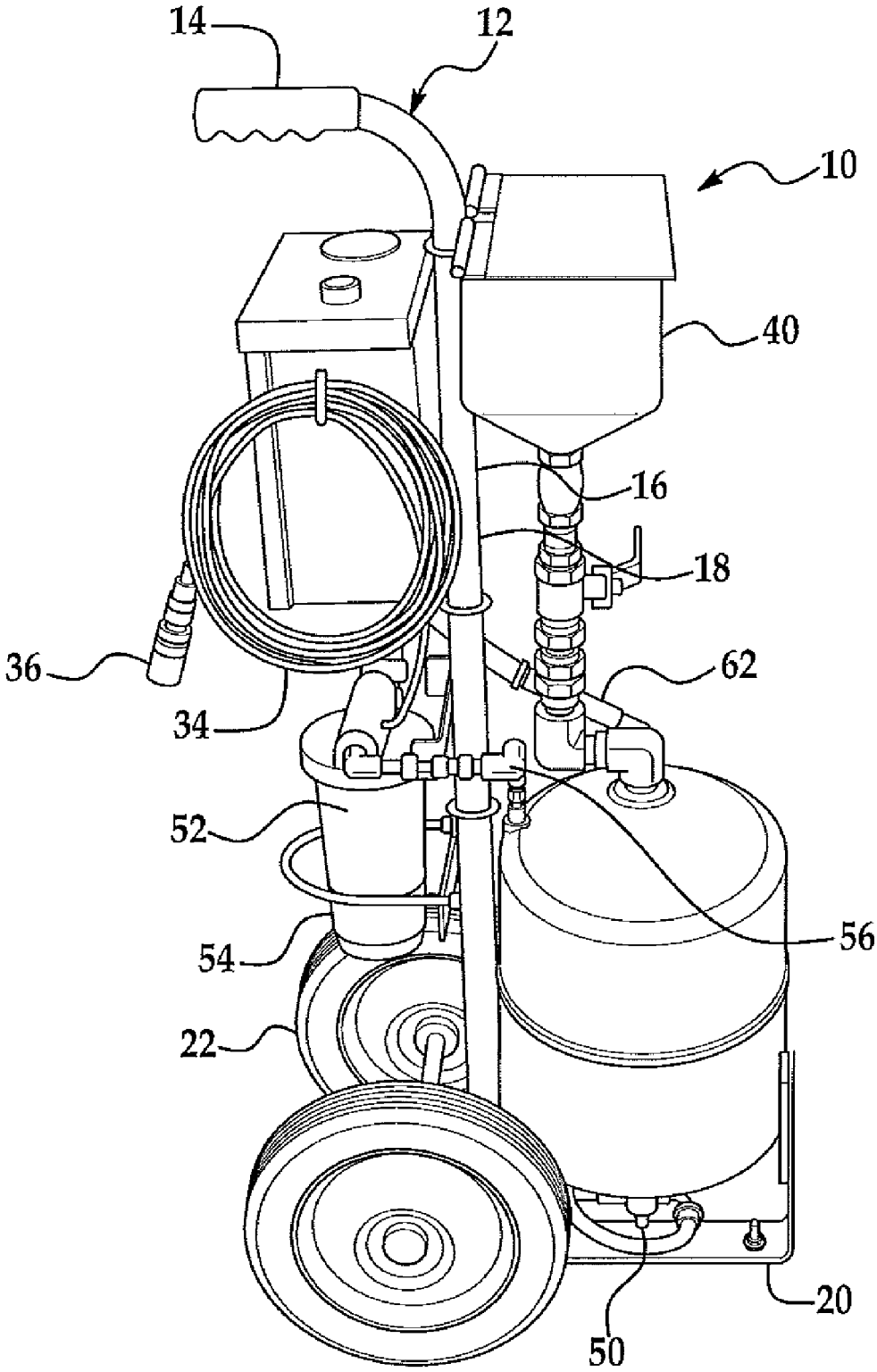
FIG. 3 is a side view of the embodiment of the device of FIG. 1.
Figure 4:
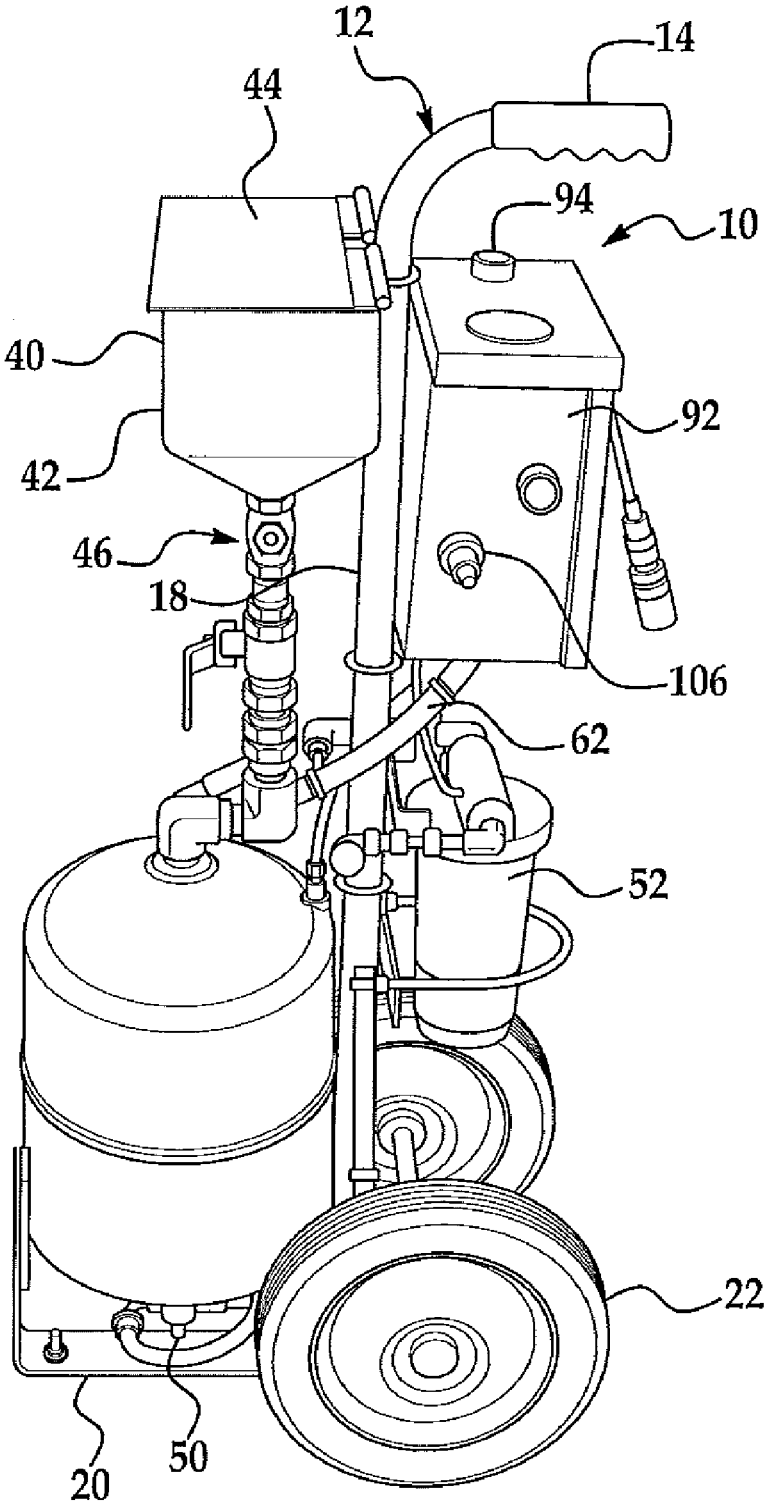
FIG. 4 is a alternate side view of an embodiment of the device of FIG. 1.

In the embodiment depicted in FIGS. 1, 3, and 4, the onboard filtration unit 52 is configured with an external housing 54 having at least one outlet in fluid communication with an intermediate conduit 56. The intermediate conduit 56 extends from the lower portion of pressurizable reservoir 30 to filter housing 54 and defines a portion of the fuel conveying conduit 34.

The intermediate conduit 56 may be configured in any suitable manner to convey the fuel from the pressurizable fuel reservoir 30 to filtration unit 52. In various embodiments, it is contemplated that the intermediate conduit 56 can be configured with suitable check valves and the like to prevent backflow of fuel and to maintain pressure in the filtration unit 52 during conveyance of fuel therethrough.

Fuel conveyed into filtration unit 52 can exit the filtration unit at a suitable junction conduit 60 in fluid communication with the filtration unit housing 54 and can be conveyed through hose portion 62 of conduit 34 into the fuel distribution system of the associated engine. In the embodiment depicted in FIGS. 1, 3, and 4, it is contemplated that hose portion 62 will be a flexible conduit of suitable length to reach the associated engine.

Where desired or required, junction conduit 60 can be configured with suitable valves to accommodate alternate two-way fluid flow through the junction conduit to facilitate delivery of fluid from the filtration unit 52 through the hose portion 62 of conduit 34 into the associated engine as well as removal of a volume of fuel from the associated engine to the pressurizable reservoir 30 to serve as at least a portion of the fuel available for use in priming operations on subsequent engines. Fuel removal can occur in any suitable manner such as the manner that will be described subsequently. The junction conduit 60 can be configured with suitable check valves and diverters to isolate the filtration unit 52 from contact with fuel removed from the associated engine via hose portion 62.

In order to ascertain the volume of fuel contained in the pressurizable fuel reservoir 30, it is contemplated that the reservoir 30 can be equipped with at least one suitable volumetric measurement tool such as a sight glass 64 or the like. Such a device can permit the operator to ascertain the condition of any fuel present in the reservoir 30 such as removed from the engine as well as determining the amount of fuel contained therein. Additionally it is contemplated that the sight glass can be calibrated in order to ascertain at least an approximation of the volume of fuel added to the reservoir 30 during any fuel replenishment operations and/or the volume of fuel delivered during any engine priming operations.

The device 10 can be employed advantageously to introduce diesel fuel as a priming material in an effective, efficient and steady manner. In certain situations, it is contemplated that fuel removed from an earlier engine priming operation can be introduced with associated filtration into a target engine to accomplish the subsequent engine priming operation. It is contemplated that fuel introduction can occur in such a manner that priming accomplishes at least one of the following: introduction of a defined volume of fuel as priming fluid, introduction over a defined interval, introduction at a defined pressure, introduction in a time-calibrated manner to reintroduce the fuel in a manner that ensures reintroduction of sufficient fuel into engine devices such as the high pressure fuel pump.

Upon completion of routine maintenance, filter change operations and the like, the fuel contained in the pressurizable reservoir 30 can be introduced into the fuel conveyance system of the associated engine by pressurization of the reservoir 30. At least a portion of the fuel contained in the reservoir 30 can be conveyed through filtration unit 52 and conduit 34 to the engine to prime engine elements such as the high pressure fuel pump and associated engine conduits.

The device 10 as disclosed herein includes suitable means for pressurizing the reservoir 30 when required. In the embodiments as depicted, the device 10 includes a suitable connection port releasably connectable to a source of pressurized gas or air. While it is within the purview of the disclosure for the device to include a suitable compressor or pressurized air source, the embodiments depicted in the various drawing figures include a suitable means for releasably connecting to a source of pressurized gas external to the device 10. The connection means can include suitable couplers and hoses to convey external pressurized air to the device 10 as well as regulators to control, monitor, and reduce pressure levels as desired or required.

When fuel priming is required, the reservoir 30 can be pressurized to a level sufficient to convey fuel into the high pressure fuel pump and any associated fuel conveyance lines of the vehicle as may be desired or required.

In the various embodiments depicted in the drawing figures, the device 10 is configured to be operated pneumatically utilizing a suitable source of pressurized air. Where desired or required, the source of pressurized air can be derived from a suitable pump, compressor, source of bottled gas or other on-board source. It is also considered to be within the purview of this disclosure to obtain pressurized air from pressurized sources on board the associated vehicle being services such as the residual pressurized air contained in the compressor system of the vehicle. It is contemplated that the device 10 can be configured to be removably coupled to an external source of pressurized gas such as a suitable shop air line or the like.

Suitable sources of pressurized gas or air will be those that can convey any suitable gaseous mixture including, but not limited to, conventional shop air, nitrogen and the like at pressures up to at least 125 psi. It is to be understood that in many situations shop gas is delivered at pressures greater than 125 psi. Elevated pressures can be utilized with delivery pressures up to and above 160 psi being contemplated in various situations. Where elevated delivery pressures are employed, it is contemplated that the device 10 may be equipped with suitable devices to step down the pressure value as desired or required.

The device 10 can include suitable coupling means to connect the device 10 to the source of pressurized gas. Where desired or required, the device 10 can include at least one line to convey the pressurized air to desired location(s) in the device 10 as well as suitable regulators and devices to reduce and maintain the introduced shop air to a suitable operational level. In the embodiment depicted, it is contemplated that the device 10 will be configured to permit pressurization of the reservoir 30 to deliver priming fuel to the engine at a suitable operational pressure, for example 80 psi. This pressure is considered exemplary for various embodiments. It is considered within the purview of this disclosure to employ other delivery pressures as desired or required. The air pressure introduced into the device will be that sufficient ultimately to pressurize the reservoir 30 and to deliver priming fuel to the associated engine at the desired or required pressure. The device 10 can include suitable coupling members and pressure regulating devices to maintain a suitable operational pressure.

The device 10 also includes suitable pressure lines connected to pressurizable reservoir 30 to convey fuel through conduit 34 to the associated engine. In the embodiment depicted in FIGS. 1, 3, and 4, pressure delivery line 62 communicates with conduit 46 to permit pressurization. Alternately, pressure line 62 can be coupled to the reservoir 30 at other suitable locations.

It is contemplated that the introduced pressurized gas can be introduced into reservoir 30 after the reservoir is filled with the desired amount of priming fuel in order to pressurize the interior of the vessel. In the embodiments as depicted, it is contemplated that the pressure delivery line 62 will be connected to the respective reservoir 30 at a location consistent with the headspace produced in the vessel upon introduction of the withdrawn fuel.

Pressurization levels are that amount sufficient to push the fuel through the fuel delivery conduit 34 and into the high pressure pump and associated engine conduits. The pressurized fuel introduction will proceed for an interval sufficient to achieve suitable priming. Specific pressurization levels and timing are generally prescribed by the engine manufacturer. In various applications, it is contemplated that priming will occur at an elevated pressure between about 60 and 100 psi for an interval between about 1 and 5 minutes, with pressures of 80 psi being utilized in certain situations and priming intervals of 2 minutes being prescribed.

It is contemplated that the device and method outlined herein can provide consistent high pressure priming over the entire interval desired in an efficient and effective manner. Introduction of pressurized gas occurs in a manner such that a pressure head is formed over the surface of the fuel contained in the reservoir 30 such that the fuel is pushed through the conduit 34 in a manner that precludes the introduction of air into the device to be primed.

Upon completing of the priming step, pressurization can be discontinued. The device 10 can be configured with suitable pressurization discontinuation devices. The discontinuation devices can include, but need not be limited to fluid level controls and feed back systems associated with the pressurization reservoir 30. It is contemplated that the reservoir 30 will be configured to contain a residual or retained volume $V_2$ of fluid fuel material when the reservoir is in the non-filled state. The retained volume $V_2$ will generally be a volume sufficient to ensure introduction of a sufficient quantity of replacement fuel at a sufficient pressure during the fuel replacement phase of operations. In certain embodiments, it is contemplated that this residual volume $V_2$ will be approximately 1 to 4 quarts. The residual volume $V_2$ will be diesel fuel that can be introduced into the receptacle by any suitable means such as through the upper chamber 40.

It is contemplated that the device 10 will include suitable level controllers and regulators to limit the maximum volume delivered from the reservoir 30 into the appropriate engine location during priming.

Figure 2:
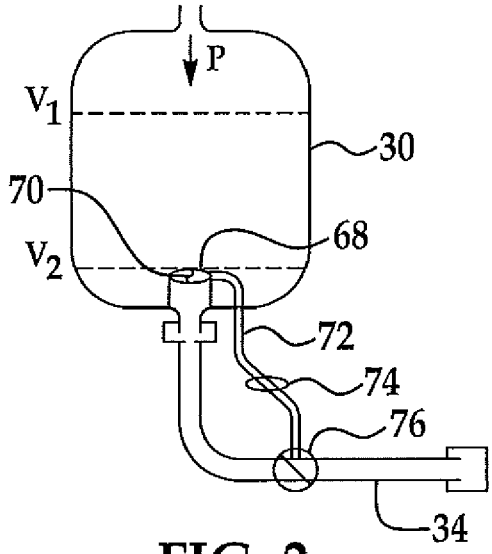
FIG. 2 is a schematic depiction of the pressurizable reservoir of an embodiment of the device as disclosed herein.

One such configuration is depicted in FIG. 2. Air pressure through float 68 is positioned in the interior of the pressurizable reservoir 30 and functions as a lower level limiting regulator in pneumatic contact with conduit 34 via line 72. When fluid levels are at or below the level defined by float 68 movement of or action upon float valve 70 can trigger a suitable message to terminate pressurization of the reservoir 30.

When the fluid level reaches the lower set level, $V_2$ defined by float 68, pressure exerted in the reservoir 30 is discontinued. The signal to discontinue pressure exertion can be transmitted by a suitable pneumatic circuit as illustrated in FIG. 2. fluid levels below $V_2$ result in movement of float valve 70 and introduction of pressurized air into line 72 triggering valve 74 (normally closed) to open discharging pressure to atmosphere. The conveyance of pressurized air through to valve 76 located in the fuel conveyance line 34 (normally open) causes it to close terminating the flow of fuel therethrough. It is also contemplated that the device 10 will be equipped with suitable environmental filters to treat and/or collect any hydrocarbons or other contaminant in the exhaust gas.

The amount of fuel introduced and/or the rate of fuel introduction can be controlled by the device 10 utilizing suitable pneumatic circuits as desired or required. It is contemplated that the device 10 can be outfitted with a suitable priming initiation system configured to commence priming operations for a given engine. In the embodiments depicted in the drawing figures, the priming initiation system is housed in a control panel or box 92 having a suitably configured pneumatic control system in which activation of the ON switch 94 routes pressurized air from entry port 96 into pressurizable reservoir 30 at a regulated pressure. In the embodiment as depicted it is contemplated that depression of the ON switch 94 opens a suitable valve permitting introduction of pressurized shop air into the device 10. It is also contemplated that this system acts on a spill preventor valve present in the associated pneumatic circuit (normally closed when not is use and during transit) to open the valve and the associated pressurizable reservoir to the introduction of pressurized air.

The control box 92 can also be fitted with a suitable off switch 98 configured and useable as an emergency kill switch. It is generally contemplated that the cycle, once initiated, will run to completion triggered by removal of the specified amount of fuel from the pressurizable fuel reservoir to the engine to be primed and action on an internal float as outlined previously. The kill switch can be configured to override such routine operations.

In the embodiment depicted herein, activation of switch 94 opens line 62 for the delivery of pressurized gas at a suitable operating pressure (for example 80 to 100 psi) into the reservoir 30. In order to prevent or minimize the potential for spillage, it is contemplated that the pressurized air delivery line can include suitable check valve or the like of which the manual cutoff valve 48 is one non-limiting example and the suitable internal ball valves (not shown) are others. In various embodiments, it is contemplated that the internal valve such as a ball valve can be utilized to permit initial or manual fuel filling (open position) while preventing backflow of fuel during operation and transit of the device 10.

Where desired or required, make-up fuel for future priming operations can be introduced through upper chamber 40. The device 10 can also be configured with means for introducing make-up fuel into reservoir 30 from the associated engine. In such a configuration, device 10 can be brought to ambient pressure and make-up fuel conveyed through housing portion 58 of conduit 34 to diverter valve configuration at conduit junction 60 where the fuel can be diverted away from filtration unit 52 into side junction into conduit 46 below or downstream of valve 48.

In order to replenish fluid in reservoir 30 through conduit 34, it is contemplated that priming steps can be implemented. Upon completion of priming steps and depressurization of pressurizable reservoir 30, the associated diesel engine can be started with the device 10 in fluid engagement via conduit 34. Operation of the associated diesel engine causes operation of the low pressure fuel pump and begins circulation of fuel in the engine. Action of the low-pressure fuel pump causes a portion of the circulating fuel to be removed into the connected reservoir 30.

Once the desired amount of fuel has been introduced into the reservoir 30 from the associated engine, engine operation can be halted and the conduit 34 decoupled.

Determination that the desired amount of fuel has been added can be accomplished by any suitable limiting device. In its simplest form, it is contemplated that the desired volume of fuel $V_1$ can be determined utilizing sight glass 64. Upon visual indication of $V_1$, the associated engine operations can be discontinued and the device 10 decoupled and moved to the next vehicle to be serviced. In this way, fuel priming operations can proceed while minimizing operator exposure to fuel and fuel handling.

Figure 5:
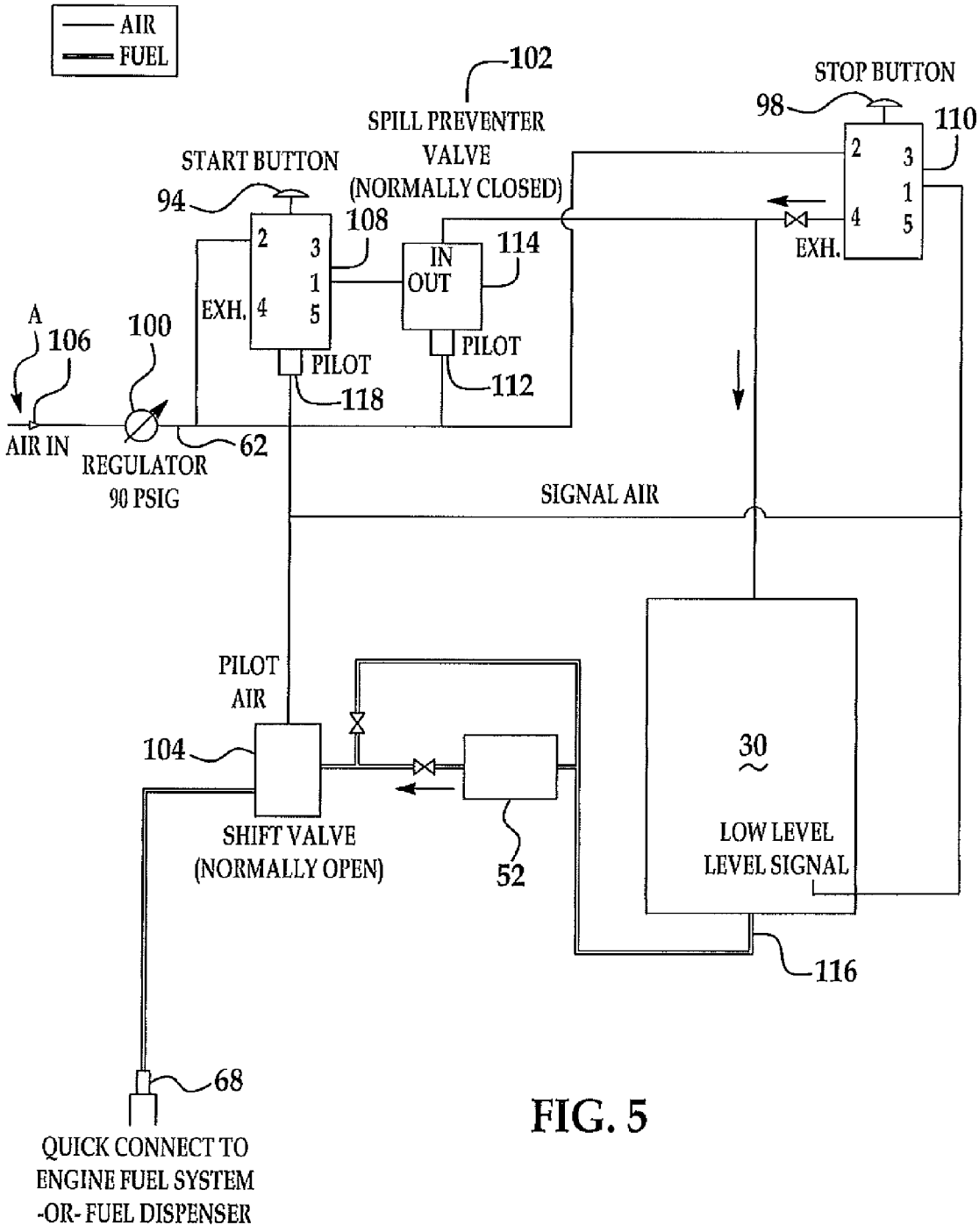
FIG. 5 is a schematic flow diagram of fuel and pressurized air in the device according to an embodiment disclosed herein

The priming process will now be discussed with particular attention to the diagram in FIG. 5.

In the process, a pressurized air source A is connected to the device 10 bringing pressure to Port 2 at the Start Button Assembly and Port 2 of the Stop Button Assembly as well as pilot at Spill Preventer Assembly 102 (depicted here as NC spring loaded valve), which opens the valve. Pressing the Start Button 94 will send air pressure to Port 1, through the valve of Spill Preventer Assembly 102 into the pressurizable reservoir 30. The air pressure introduced into reservoir 30 pushes the fuel through the bottom drain into conduit 34 through check valve 106. The fuel passes through filtration unit 52 through shift valve 104 through coupling member 38 such as a quick connect fitting, which connects to the engine fuel system.

When the fuel level reaches the predetermined low level $V_2$, air will enter through a suitable low level switch 110 such as the configuration described previously. This (signal) air pressure will activate the pilot 112 of the Start Button Assembly, connected via line 114, closing the valve and shutting off the air supply to the tank and will close the Shift Valve 108, stopping the flow of fuel into the associated engine reservoir 30. Signal air will exhaust through the Spill Preventer Valve 104, via Port 1 and Port 4 (exhaust) of the Start Button Assembly. It is generally contemplated that there will be air pressure to the Spill Preventer Valve to keep this valve opened for the exhaust.

Depression of the Stop Button 98 sends air from Port 2 to Port 1 into the signal air line, with the same result as when the fuel level is too low, in effect mimicking a low fuel signal. Releasing the Stop button allows the air pressure to relieve via Port 4, through the check valve, the Spill Preventer Assembly and Port 1 and Port 4 of the Start Button Assembly. The Spill Preventer Assembly ensures that no fuel gets spilled in case the device 10 tips over and it also ensures that no fuel vapor escapes from the system.

In order to charge the reservoir with fuel, the device 10 is connected to the associated engine using the suitably matable quick connect fittings. Connection can occur at any suitable engine location however in various embodiments, it is contemplated that the connection can be a suitable compucheck type connection located in the fuel conveyance conduit. In order to replenish fuel in the reservoir 30, a suitable volume of fuel can be pumped into the device 10 using a suitable pumping means such as the associated diesel engine itself. Once priming operations have been completed, while the device 10 is still coupled, the engine can be started initiating fuel circulation. A portion of the circulating fuel can be diverted into conduit 34 via coupler 38 in the direction of arrow B. Entry of fuel into filtration device 52 is prevented by a suitable one-way flow valve such as valve 116 directing the fuel into cross over conduit 118 into reservoir 30, Crossover conduit 118 and valve can be associated with conduit junction 60 as desired or required and can terminate in conduit 46 as required.

While the invention has been described in connection with what is presently considered to be the most practical and preferred embodiments, it is to be understood that the invention is not limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A money saving universal fuel priming assembly comprising:

means for establishing fluid communication with a source of used fuel;

a pressurizable reservoir for holding a quantity of fuel, at least a portion of the fuel derivable from the source of used fuel;

a first conduit fluidly communicating with the source of used fuel and the pressurizable reservoir;

at least one filtration device, capable of sequestering at least a portion of contaminants contained in the used fuel;

means for conveying pressurized air derived from a pressurized air source to the reservoir for an interval sufficient to introduce fuel into contact with at least a high pressure fuel pump located in a fuel delivery system in a diesel engine; and a second conduit fluidly communicating with the pressurizable reservoir, the second conduit configured to be releasably connected with an engine to be primed.

2. A method for replacing fuel in a diesel fuel filter of a diesel engine comprising the step of:

Connecting the money saving universal fuel priming assembly as defined in claim 1 to an associated engine-mounted fuel conveying conduit;

Introducing diesel fuel collected from at least one engine-mounted fuel conveying conduit and sequestered in the pressurizable reservoir into the associated engine-mounted fuel conveying system, the introduction occurring under pressure for an interval sufficient to prime at least a high pressure fuel pump located in the fuel conveying system of the engine.

3. The method of claim 2 wherein the introduction interval is at least two minutes and the introduction pressure is at least 75 psi.

4. The method of claim 3 wherein the introduction pressure is derived from a pressurized air source external to the device.

5. The money saving universal fuel recycling assembly of claim 1, further comprising a selectively opened drain in the reservoir, said drain in fluid communication with the interior of the reservoir for drawing water therefrom, and means for selectively opening and closing the respective drains.

6. The money saving universal fuel recycling assembly of claim 5, wherein the first conduit, the reservoir, and a first portion of the second conduit are housed on a mobile unit transportable to a remote source of used fuel.

7. The money saving universal fuel recycling assembly of claim 6, further comprising a quick connect couple having a first coupling fluidly secured to the first portion of the second conduit and second mating coupler connected to a second portion of the second conduit, said reservoir in fluid communication with the collection receptacle when the quick connect coupler is engaged.

* * * * *